US009695680B2

(12) United States Patent
Bergman

(10) Patent No.: US 9,695,680 B2
(45) Date of Patent: Jul. 4, 2017

(54) PLUNGER LIFT OPTIMIZATION

(71) Applicant: CONOCOPHILLIPS COMPANY, Houston, TX (US)

(72) Inventor: Patrick W. Bergman, Fulshear, TX (US)

(73) Assignee: ConocoPhillips Company, Houston, TX (US)

( * ) Notice: Subject to any disclaimer, the term of this patent is extended or adjusted under 35 U.S.C. 154(b) by 227 days.

(21) Appl. No.: 14/526,684

(22) Filed: Oct. 29, 2014

(65) Prior Publication Data

US 2015/0136389 A1 May 21, 2015

Related U.S. Application Data

(60) Provisional application No. 61/907,227, filed on Nov. 21, 2013.

(51) Int. Cl.

| | |
|---|---|
| ***E21B 43/12*** | (2006.01) |
| ***E21B 47/00*** | (2012.01) |
| ***F04B 47/12*** | (2006.01) |
| *E21B 41/00* | (2006.01) |

(52) U.S. Cl.
CPC ..... *E21B 43/121* (2013.01); *F04B 47/12* (2013.01); *E21B 2041/0028* (2013.01)

(58) Field of Classification Search
CPC ..... E21B 43/121; E21B 43/129; E21B 2041/0028
See application file for complete search history.

(56) References Cited

U.S. PATENT DOCUMENTS

| | | | | |
|---|---|---|---|---|
| 5,878,817 | A | 3/1999 | Stastka | |
| 5,957,200 | A | 9/1999 | Majek et al. | |
| 6,241,014 | B1 | 6/2001 | Majek et al. | |
| 7,451,823 | B2 | 11/2008 | Wilson | |
| 7,464,753 | B2 | 12/2008 | White et al. | |
| 7,681,641 | B2 | 3/2010 | Mudry | |
| 7,950,464 | B2 | 5/2011 | Atencio et al. | |
| 8,296,100 | B2 | 10/2012 | Schipperijn et al. | |
| 2007/0012442 | A1 | 1/2007 | Hearn | |
| 2007/0261845 | A1* | 11/2007 | White | E21B 43/121 166/250.15 |
| 2008/0202746 | A1 | 8/2008 | Mudry | |
| 2008/0270328 | A1 | 10/2008 | Lafferty et al. | |
| 2011/0060472 | A1 | 3/2011 | Ocondi et al. | |
| 2012/0193091 | A1 | 8/2012 | Bender et al. | |
| 2013/0071262 | A1 | 3/2013 | Green | |
| 2013/0173165 | A1 | 7/2013 | Balogun et al. | |
| 2014/0102698 | A1 | 4/2014 | Bergman | |

OTHER PUBLICATIONS

International Search Report. PCT/US14/62890. Dated Jan. 29, 2015.

* cited by examiner

*Primary Examiner* — Zakiya W Bates
(74) *Attorney, Agent, or Firm* — ConocoPhillips Company

(57) ABSTRACT

A logic used to auto-adjust plunger lift system parameters optimizes oil and gas well production with minimal human interaction. The auto-adjustments place and maintain the well in an optimized state wherein the well has either a Minimum-OFF time (e.g., length of time just long enough for the plunger to reach the bottom of the well), or Minimum-ON time (e.g., flowing just long enough for the plunger to reach the surface) cycle.

15 Claims, 11 Drawing Sheets

PLUNGER LIFT OPTIMIZATION

CROSS-REFERENCE TO RELATED APPLICATIONS

This application is a non-provisional application which claims benefit under 35 USC §119(e) to U.S. Provisional Application Ser. No. 61/907,227 filed Nov. 21, 2013, entitled "PLUNGER LIFT OPTIMIZATION," which is incorporated herein in its entirety.

FIELD OF THE DISCLOSURE

The disclosure generally relates to optimizing oil production by employing logic steps in a plunger lift controller to adjust cycle parameters in such a way so as to minimize bottom hole pressure and maximize production (i.e. optimize the plunger lift cycle).

BACKGROUND OF THE DISCLOSURE

As natural gas is produced from gas wells, the pressure in the formation will decrease, resulting in a reduction in gas flow rate and associated gas velocity. Before the natural drive pressure is reduced, the flow rate and velocity of produced gas may be sufficient to remove the liquids from the well with the gas. However, at some point the flow rate of gas will be insufficient to carry liquids out of the well. As a result, the liquid loading in the well will increase, and liquid will collect in the bottom of the well further reducing its output.

When production by natural reservoir pressure becomes uneconomical, artificial lift techniques can be utilized to increase well production. A number of artificial lift systems are known in the industry, including sucker rod pumps, gas lift techniques and plunger lift techniques.

A plunger lift is an artificial lift method used to de-liquefy natural gas wells and high gas-to-liquid ratio oil wells. A plunger is used to remove contaminants from productive natural gas wells, such as water (as a liquid or mist), oil, condensate and wax. FIG. 1 shows a schematic of a typical plunger system, including: a Lubricator to cushion the impact of an arriving plunger and provide safe access to the plunger; a Catcher which catches and holds the plunger in the lubricator for save removal; a controller to open and close the motor valve using time, pressure, or flow rate and provide production history for the operator; a Motor Valve pneumatic diaphragm-activated valve to start and stop the well's production based on input from the controller; a Solar Panel to provide a power source to the controller batteries; a Drip Pot to prevent downtime by trapping and preventiong condensate, water, and other contaminates from clogging the latch valves; an Arrival Sensor to signal the plunger's arrival to the controller; a Plunger stell "piston" that acts like a swab creating a seal to the tubing and lifting liquids and solids (sand, salt, coal fines, paraffin, and scale) to the surface; and a Bottom Hole Bumper Spring that sits above the seating nipple, protecting the plunger upon impact and can also hold a ball and seat to trap liquids in the tubing. The plunger cycles between the top and bottom of the well to lift fluids to the surface, as illustrated in FIG. 2. A more detailed graphic of a plunger lift system is also in FIG. 3.

The basic function of the plunge lift controller is to open and close the well shutoff valve at the optimum times, to bring up the plunger and the contaminants and maximize natural gas production. A well without a de-liquefaction technique will stop flowing or slow down and become a non-productive well, long before a properly de-liquefied well will.

Conventional plunger lift systems, which are also known as free piston systems, utilize a plunger (piston). The well is shut in and the plunger falls to the bottom of the tubing and onto a bumper spring, seating nipple or stop near the bottom of the tubing (FIG. 2, "Off Time"). After pressure in the well has built, the wellhead is opened to flow and the high pressure gas located within the well pushes the piston upward to the surface ((FIG. 2, "Lift"), thereby pushing the liquid on top of the plunger to the surface and allowing the well to produce for as long as possible (FIG. 2, "After flow"). This sequence can be repeated by closing the wellhead off and allowing the plunger to fall again to the bottom of the well while pressure in the well is allowed to rebuild.

Automatic control of plungers used in plunger lift systems is known in the art. Generally, an electronic controller can be utilized that is able to control all of the various valves required to open and close the well, monitor the position of the plunger, and if the well is equipped with a plunger catcher, catch the plunger at the surface. Such controllers may, for example, use pressure within the well, production flow rate, or travel time of the plunger in order to determine when to perform various operations. Alternatively, an electronic controller may simply operate based on a preset, timed schedule.

U.S. Pat. No. 7,681,641, for example, describes a self-adjusting process to adjust thresholds based on plunger arrival. In turn, those thresholds are used as open and close triggers that open and close the sales valve (i.e. determine how long it is shut-in or flows).

U.S. Pat. No. 7,464,753 describes the use of non-linear (fuzzy logic) to make adjustments to open and close triggers based on looking at plunger arrival time for previous cycles, with the previous cycle data stored in the micro-processor memory. This is an attempt to improve the efficiency of the self-adjust process by allowing for variable sized changes to control thresholds.

U.S. Pat. No. 6,241,014 uses dampened response and exponential response as a method to determine how much to adjust open and close triggers, with all references being made to time-based triggers.

U.S. Pat. No. 5,957,200 uses a microprocessor to evaluate tubing and casing pressures as open and close triggers.

Even though each of these patents discusses adjustments made to open and close triggers and that making such adjustments are necessary to optimize production from a plunger lift well, none of them ever describe what constitutes an optimized plunger cycle or what logic is required to achieve that optimization. It is quite possible the patents use purposefully vague language, because it was not understood what an optimized plunger cycle looks like, nor which parameters should be modified and how for optimization purposes.

This invention provides these missing components.

SUMMARY OF THE DISCLOSURE

Most wells currently using plunger lift employ microprocessors that evaluate various well conditions and make determinations as to how long the well is shut-in and how long it flows. There are several patents describing which parameters are used, the analysis done, and how those parameters should be changed (self-adjusted) while well conditions are changing. Many of these patents mention that the intent is to optimize production from the well, but they never address what optimization looks like, nor do they incorporate the precise steps required to reach that optimized state. Instead, they use verbiage like "because each well will have its own unique properties, the automatic controller closing and opening the plunger lift control valve must be suitable for use on a wide variety of wells and be flexible enough to adjust to the changes that often occur during the life of the well to provide on going optimum production". However, the actual details needed to optimize plunger lift control in various conditions are never provided.

In contrast, this disclosure describes a set of logic steps that will modify the close trigger and open trigger set points that determine the length of flow and length of shut-in of a plunger lift well so to achieve the combination that minimizes bottom hole pressure, there by maximizing production. The logic steps are capable of being integrated into existing controllers that use time to determine the length of flow and length of shut-in as well as controllers that use a combination of rates and pressures to determine when to open and close the sales valve (i.e. open and close triggers).

An optimized conventional plunger lift well will fit one of two different criteria, that of having the length of off-time be at the 'Minimum-OFF' time (e.g., length of time just long enough for the plunger to reach the bottom of the well, see FIG. 4), or having a length of on-time be at the at the 'Minimum-ON' time (e.g., flowing just long enough for the plunger to reach the surface, see FIG. 6). For each requirement, the plunger must be operating within a targeted velocity to ensure optimal conditions.

In order for a conventional plunger lift well to be optimized, it must be either a Minimum-OFF well, a Minimum-ON well, or occasionally one that meets both criteria (FIG. 5), but if it meets neither criteria, the plunger lift well will not have achieved the lowest possible bottom hole pressure and therefore cannot be considered optimized (FIG. 7).

To achieve and maintain a plunger lift well in an optimized state, even with the most sophisticated plunger lift controller (micro-processor and program logic), requires someone knowledgeable in plunger lift optimization to monitor and adjust the control parameters of the plunger lift controller as well conditions change.

Many people do not understand the cycle related changes required to achieve and maintain the shut-in and flow combination that minimizes the bottom hole pressure and maximizes production from the well. Even if people have that knowledge, many times they do not always have easy access to the information required to do the analysis or time to optimize the well. And, since optimization can be an iterative process, by allowing it to be done by the controller on every cycle, makes it much faster than having a person periodically make adjustments.

To date, no one has automated the optimization process. Engineers have refined the techniques plunger controllers used to make changes, but they have never incorporated the steps required to reach and maintain the optimized state. When a well is not optimized, the current process consists of manually changing settings in a controller so as to drive the well to one of the two optimized types. Thus, time and money is spent on training people on plunger lift optimization principles and implementing these principles to reach an optimized well status.

The new logic described herein eliminates the need for continual human intervention and potential misinterpretations of plunger optimization principles, as those principles relate to how the well should be cycled to achieve an optimized state. This logic will adjust the flow period and shut-in periods automatically so as to minimize bottom hole pressure and maximize producing rate. It will also change the cycle characteristics of the well to maintain the minimum bottom hole pressure as reservoir, surface conditions, and equipment related items change. Once properly setup, it will essentially do this with minimal human intervention.

Thus, the present disclosure also minimizes the need to train people in plunger lift optimization as it relates to how the well should be cycled. Training for other aspects of the optimization process, such as surface and down hole equipment maintenance and surface pressure settings, is still necessary. However, since training on the principals of how to cycle a well is often the most difficult and time consuming, the presently disclosure logic will save time and cost.

Current plunger lift controllers compare conditions to certain thresholds and open and close the well when those thresholds are met. Many controllers monitor plunger arrival velocity, or time and adjust those thresholds to achieve a desired result. However, to optimize a well that is not a Minimum-OFF well or a Minimum-ON well requires that someone knowledgeable in plunger lift optimization continually monitor and adjust those settings/thresholds to drive the well to become one of those two characteristic well types. The proposed logic eliminates the need for an individual to make adjustments to the settings to achieve an optimized well (e.g., Minimum-OFF well or Minimum-ON well).

The logic shown in FIGS. 8 and 9 determines if the well meets the requirements for either of the two desired well types and automatically makes adjustments that drive the on-time (flow) and/or off-time (shut-in) parts of the cycle to meet the optimized state (Minimum-OFF or Minimum-ON), regardless of the state of the well when the process is started. Once the optimized state is achieved, the logic will maintain the well in the optimized state by responding to changes in outside influences (e.g., declining reservoir pressure, changes in surface pressure, changes in gas liquid ratio, plunger wear, corrosion, etc.).

This logic could potentially be used on some microprocessors by itself, but in most cases will be added to existing plunger lift control logic, so it can take advantage of the other functionality that those controllers bring to the operation.

The logic/process can generally be described as follows:

Information Needed (Controller Source):

- Was High Line Delay activated since last flow period? (Yes or No)
- Did plunger arrive? (Yes or No)
- Plunger Arrival Time
- Valve Open Time
- Valve Close Time Calculations Needed:

- High Line Delay was activated X cycles ago (# value)
- Consecutive Non-arrivals (# value)
- Afterflow Length (minutes)
- Off Time Length (minutes)
- Plunger Arrival Velocity (calculated from plunger arrival time)
- Plunger Arrival Velocity relative to the Target Plunger Arrival Velocity Upper Limit
- Plunger Arrival Velocity relative to the Target Plunger Arrival Velocity Lower Limit The above calculations are directed towards plunger arrival and plunger velocity. The actual plunger velocity needs to be within the upper and lower velocity limits for the type of plunger (i.e. target plunger arrival velocity) being used to prevent wear and damage to the well.

Settings (Either Added to Current Controller Settings or from Controller Current Settings):

- High Line Delay Recovery Auto-adjust Pause (HLDRAP)—Number of Cycles (e.g. 2 or more)
- Consecutive Non-arrival Shut-in—Number of Cycles (e.g. 3 or more)
- Non-arrival Open Trigger Auto-tune Multiplier (NAOTAM)—Factor (e.g 2 or 2.5)
- Minimum-ON Maximum Afterflow Set Point (minutes)
- Minimum-OFF Time (minutes)
- Desired Plunger Arrival Velocity
- Target Plunger Arrival Velocity Upper Limit
- Target Plunger Arrival Velocity Lower Limit
- Depth to seating nipple or stop
- Open Trigger Set Point (for various open triggers CP–LP, CP/LP, CP, LR, TP–LP, TP, Time, etc.)
- Open Trigger Auto-Tune Increment Value
- Open Trigger Auto-Tune Decrement Value
- Close Trigger Set Point (Flow <, % Critical Lift, DP, Casing Dip, Time, etc.)
- Close Trigger Auto-Tune Increment Value
- Close Trigger Auto-Tune Decrement Value Potential Enhancements to the System can Include the Following:

- Have the controller look for slug arrival and if slug arrives without a plunger arrival indicated by the arrival sensor, over-ride consecutive non-arrival shut-in.
- Incorporate a vent option to assist the plunger surfacing when a non-arrival is indicated.
- Incorporate detection of the plunger reaching the bottom of the well to establish the Minimum-OFF time.

As used herein, "Open Time" or "ON Time" means the rise/lift time for the plunger plus any afterflow time.

As used herein, "Close Time" or "OFF Time" means the fall time for the plunger plus any extra time to allow pressure to build in the well.

As used herein, "Open Trigger" means thresholds that trigger the opening of the well (e.g., the beginning of "ON time").

As used herein, "Close Trigger" means thresholds that trigger the closing of the well (e.g., the beginning of "OFF time").

As used herein, "Open Trigger Set Point" refers to the threshold value for the open trigger above which, if the Minimum-OFF time is satisfied, the flow/on portion of the cycle will begin.

As used herein, "Closed Trigger Set Point" refers to the threshold value for the closed trigger above which will cause the well to shut-in starting the off time portion of the next cycle.

As used herein "Afterflow Length" refers to the length of time during a cycle that the well flows after the plunger has arrived at the surface. "OFF Time Length" refers to length of time during a cycle while the well is shut-in (not flowing). "ON Time Length" refers to the length of time during a cycle that the well flows. This includes the time when the plunger is traveling to the surface and any afterflow.

As used herein, "Minimum-ON Maximum Afterflow Set Point" refers to the number of minutes of afterflow above which the well is not considered a Minimum-ON well.

As used herein, "Minimum-OFF Time" refers to a controller setting (usually in minutes) before which the controller will not start the open portion of the cycle. It is intended to insure sufficient closed time has occurred for the plunger to reach the bottom of the well and is often equal to the plunger travel time to the bottom.

As used herein, "High Line Delay" refers to a delay feature used when line pressure exceeds a pre-set limit. This delay causes the well to stop cycling until the line pressure falls below a pre-determined setting. In some controllers, if the line pressure remains high, the delay times out and the well will remain shut in.

As used herein, "Non-arrivals" refers to failed plunger arrivals and "Consecutive Non-arrivals" refers to the number (two or more) of failed arrivals in a row of plunger runs.

As used herein, "Consecutive Non-arrival Shut-in" refers to the number of consecutive cycles the plunger does not arrive, which causes the controller to stop cycling the well until an operator manually re-starts the cycling process.

As used herein, "High Line Delay Recovery Auto-adjust Pause" or "HLDRAP" means the number of full cycles since the most recent cycle pause because of a high line delay.

As used herein, "Auto-Tune Value" means the increment or decrement made to the open and close trigger set points when the plunger arrival velocity is outside of the range set in the controller. The increment and decrement values are settings that are set for each trigger. (e.g. C/L, % critical lift, etc.).

As used herein, "Non-arrival Open Trigger Auto-tune Multiplier" or "NAOTAM" is a number which is multiplied times the open trigger increment value and added to the open trigger setting when the number of consecutive non-arrivals exceeded a set point, resulting in additional off time to recover from an abnormal set of conditions. The purpose of the NAOTAM is to help accumulate more energy (through increasing shut-in time and therefore accumulated pressure/energy) during the off cycle than a normal incremental (or decremental) change. Typically, the multiplier can be any value, normally 1.5-6, preferable 2-4, and most preferably 2-3.

As used herein, "Close Trigger Auto-Tune Increment" and "Open Trigger Auto-Tune Increment" are the amount of adjustment made to the close or open trigger thresholds if the plunger arrival velocity is below the Target Plunger Arrival Velocity Lower Limit.

As an example of the auto-tune increment, if the close trigger being used is % critical lift rate and the controller is using 1.9 or 190% of critical lift rate to close the well, the auto-tune increment might be 0.1. When the controller detects a slow plunger arrival, the trigger set point would be changed to 2.0 or 200% of critical lift for the next cycle, causing the well to close sooner resulting in the accumulation of a smaller fluid slug which requires less energy to lift. Also, if the open trigger being used is C/L (casing pressure divided by line pressure), and the controller is using 1.6, the auto-tune increment might be 0.2. This would cause the trigger value to be changed to 1.8 if the controller detected a slow plunger arrival. This would allow more build up pressure to accumulate prior to opening the well thereby causing the plunger to rise at a higher velocity during the next cycle.

As used herein, "Open Trigger Auto-Tune Decrement" and "Close Trigger Auto-Tune Decrement" are the amount of adjustment made to the open or trigger thresholds if the plunger arrival velocity is above the Target Plunger Arrival Velocity Upper Limit.

As an example of an auto-tune decrement, if the close trigger being used is % critical lift rate and the controller is using 1.9 or 190% of critical lift rate to close the well, the auto-tune decrement might be 0.1 or 10%, so when the controller detects a fast plunger arrival, the trigger set point would be changed to 1.8 or 180% of critical lift for the next cycle causing the well to flow longer resulting in the accumulation of a larger fluid slug which requires more energy to lift. Also if the open trigger being used is C/L (casing pressure divided by line pressure), and the controller is using 1.8, the auto-tune decrement might be 0.2 which would cause the trigger value to be changed to 1.6 if the controller detected a fast plunger arrival. This would result in a lower build up pressure required prior to the well opening thereby causing the plunger to rise at a lower velocity during the next cycle.

As used herein "Load Ratio" means a ratio of casing pressure minus tubing pressure divided by casing pressure minus line pressure, i.e. (CP–TP)/(CP–LP). This ratio is often used as an open trigger.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, sensors, and the like.

The following abbreviations are used herein:

| ABBREVIATION | TERM |
|---|---|
| CP | Casing Pressure |
| LP | Line Pressure |
| HLDRAP | High Line Delay Recovery Auto-adjust Pause |
| NAOTAM | Non-arrival Open Trigger Auto-tune Multiplier |
| C-L | Casing Pressure minus Line Pressure |
| C/L | Casing Pressure divided by Line Pressure |
| C | Casing Pressure |
| LR | Load Ratio |
| TP-LP | Tubing Pressure minus Line Pressure |
| TP | Tubing Pressure |
| Flow < | Flow Rate less than |
| % Crit Lift | Percent of the Critical Lift Rate |
| DP | Differential Pressure Across an Orifice Plate Meter |
| H-L Delay | High line delay |
| Casing Dip | Casing Pressure Rise After a Decrease in Casing Pressure During Flow |

DETAILED DESCRIPTION

Figure 1:
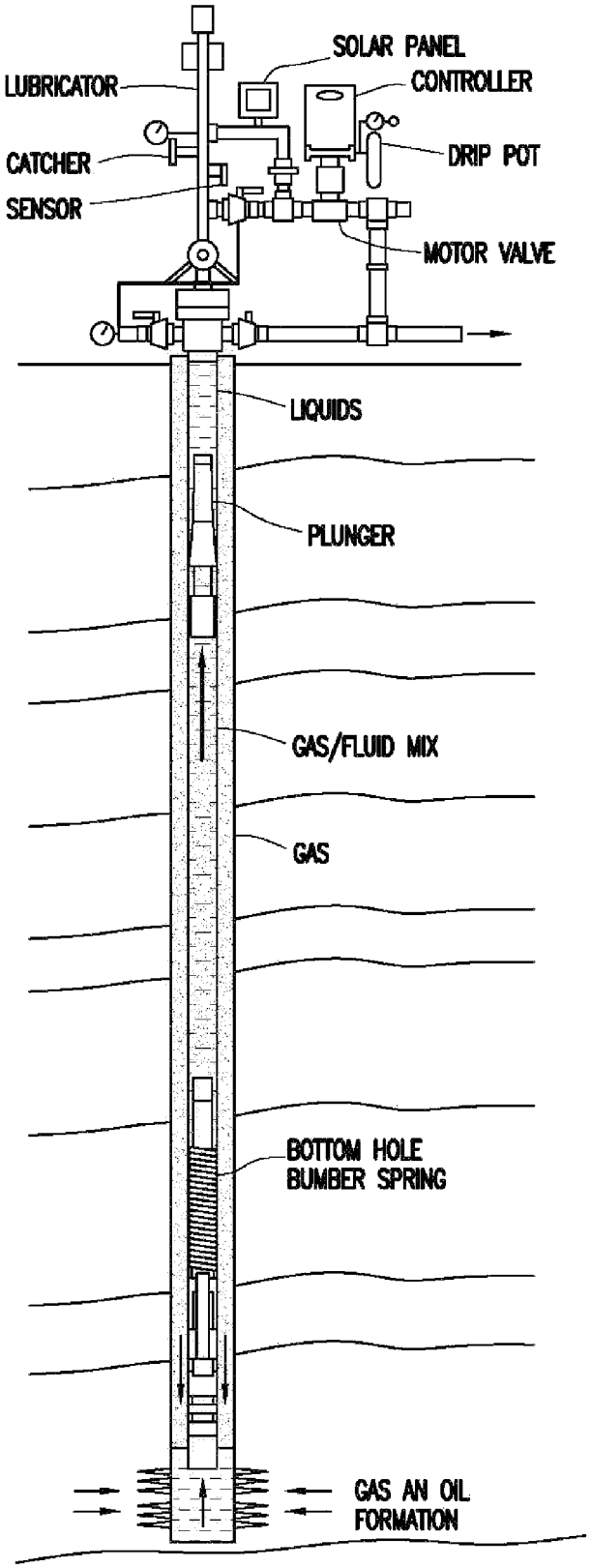
FIG. 1 schematic of a typical plunger lift system, in this case the system from Production Control Systems.
Figure 2:
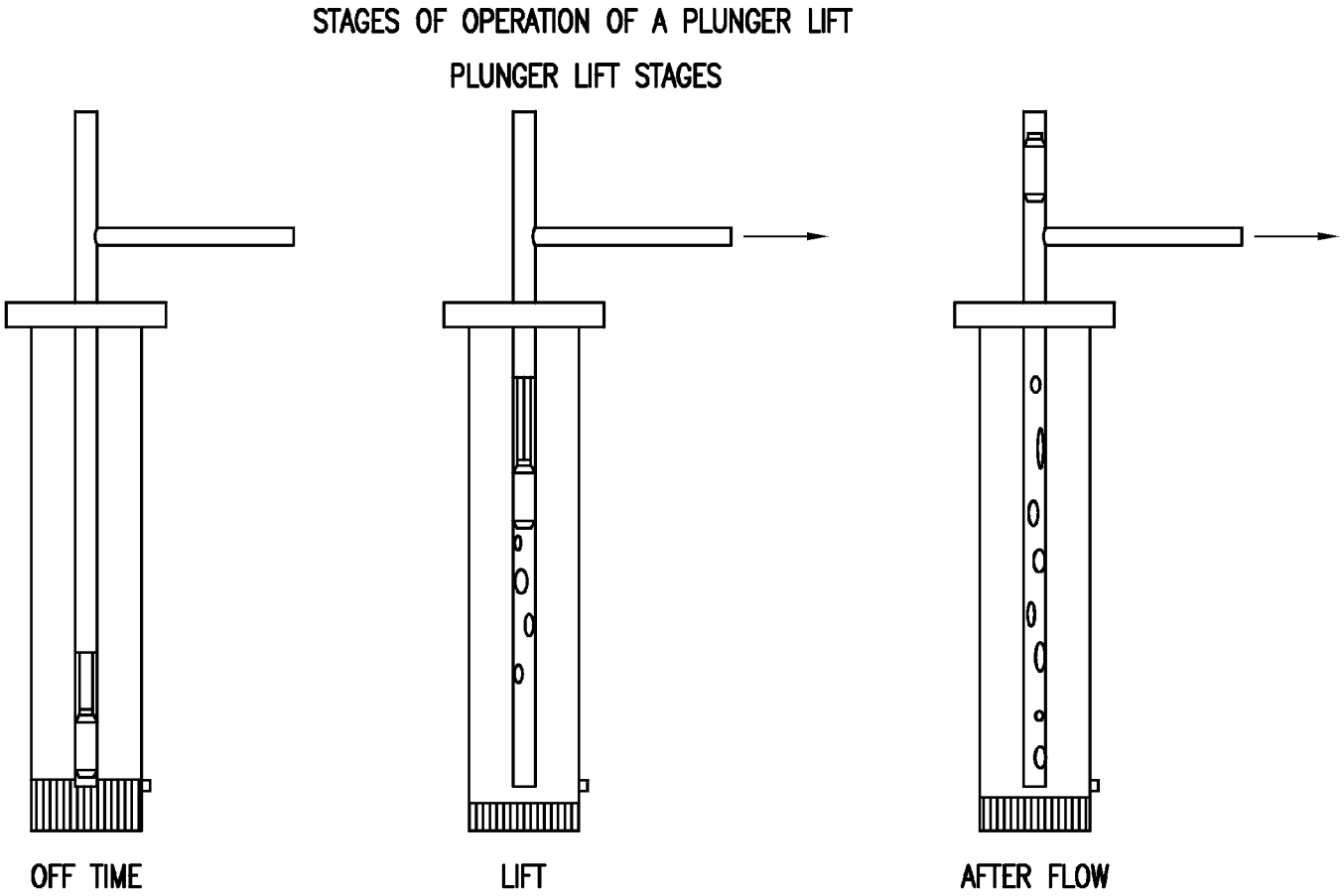
FIG. 2. Schematic of plunger lift stages showing off time where plunger has traveled to the bottom of the well, lift or rise when the well is open to production as the plunger and fluid slug travels to the surface, and afterflow when the well continues to flow after the plunger has arrived at the surface.

The disclosure provides novel control logic used to control a plunger lift system to maximize hydrocarbon recovery from a well. The invention comprises any of the following embodiments in any combination thereof:

An improved method of optimizing a ON and OFF cycle of a plunger lift system for a well, the plunger lift system having a cased well, a plunger in the cased well moveable from a stop at the bottom of the cased well to a top of the cased well, a control valve in functional connection with the cased well, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the improvement comprises said controller optimizing for Minimum-OFF time for said plunger, or optimizing for Minimum-ON time for said plunger, or both, based on current cycle parameters.

A method for auto-optimizing the operation of a plunger lift well comprising a well casing, production string within the well casing, a take-off line in fluid communication with the production string, a plunger within the production string, a stop near the bottom of the production string, a plunger lift control valve connected between the production and the take-off line, and a controller system, the controller system having a logic that compares actual well parameters with target parameters and a memory, wherein said controller system serves to open and close the plunger lift control valve according to values calculated and makes adjustments to said values based on comparisons made by the logic, said method comprising the steps of:

entering a predetermined upper limit for afterflow time during a Minimum-ON cycle time, a plunger arrival velocity, an open time, a closed time, a multiplier and a auto-tune value into the controller system memory, wherein the controller system automatically calculates the open time based on the entered predetermined values;

conducting one or more operating cycles wherein the controller system opens and closes the plunger lift control valve to allow fluids or hydrocarbons to flow into the take-off line, said one or more operating cycles comprising: i) entering a closed cycle and closing the plunger lift control valve for a period of time equal to the initial close time; ii) entering an open cycle and opening the plunger lift control valve for a period of time equal to the calculated open time and allowing fluids to be artificially lifted by the plunger within the production string for a lift time; and iii) entering an afterflow cycle for an after flow time equal to open time minus said lift time, wherein said fluids and hydrocarbons flow into the take-off line during said afterflow cycle; and adjusting the close time or open time, wherein the logic cycles compares the current operating afterflow time with said upper limit of afterflow time during a Minimum-ON cycle time and, if said current operating afterflow time is smaller, then said logic compares operating plunger velocity with the predetermined upper and lower limits and adjusts the close time according to said evaluations, and if said afterflow time is greater, then said logic compares the current operating off time with said upper limit of Minimum-OFF time during a Minimum-OFF cycle time and, if said current operating off time is less than or equal to Minimum-OFF time, then said logic compares operating plunger velocity with the predetermined upper and lower limits and adjusts the open time by an auto-tune increment or decrement according to said evaluations;

conducting one or more adjusted operation cycles, each adjusted operation cycle comprising: i) entering a closed cycle for a period of time equal to the adjusted close time and closing the plunger lift control valve; ii) opening the plunger lift control valve for a period of time equal to the calculated open time and allowing fluids to be artificially lifted by the plunger within the production string for a lift time; and iii) entering an adjusted afterflow cycle for an adjusted afterflow time equal to the adjusted open time minus said lift time, wherein said fluids and hydrocarbons flow into the take-off line during said adjusted afterflow cycle; and iv) repeating until said operating afterflow is within said lower than said upper limit of afterflow time and said operating plunger velocity is within said predetermined upper and lower limits.

A improved plunger lift system, wherein the plunger lift system having a tubing positioned in a cased well, a plunger in the tubing moveable from the bottom of the tubing to a top of the tubing, a stop near the bottom of the production string, a control valve in functional connection with the tubing, a control valve sensor for measuring time valve is open or closed, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the receiving signals relay real time values of said system parameters of each preceding cycle, said improvement comprising: a logic sequence for incorporation in said controller that evaluates real time operating afterflow value against a predetermined target afterflow range, wherein a smaller real time afterflow value results in a first evaluation of the actual plunger velocity against predetermined target velocity range and adjust to the OFF time based on said evaluation, wherein a larger real time afterflow value results in a comparison of real OFF time to predetermined OFF range and a smaller real OFF time results in a second evaluation of the actual plunger velocity against predetermined target velocity range and adjust to the ON time based on said evaluation and a larger real OFF time results in a third evaluation of the actual plunger velocity against predetermined target velocity range and adjust to the ON and OFF time based on said evaluation.

A method of monitoring and optimizing a ON and OFF cycle of a plunger lift system for a well, the plunger lift system having a tubing positioned in a cased well, a plunger in the tubing moveable from the bottom of the tubing to a top of the tubing, a stop near the bottom of the tubing, a control valve in functional connection with the tubing, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the receiving signals relay actual values of said system parameters, a logic for making decisions based on receiving signals, the method comprising the steps of: i) defining an upper and lower target limit for an afterflow time, said plunger arrival velocity, an ON time and an OFF time; ii) using said logic to compare said received signals with said target limits in a) to determine if said received signals fall outside said limits, wherein said logic determines an adjustment to an ON or OFF cycle is necessary if said received signals fall outside said limits, and iii) adjusting said ON and OFF cycle by a first predetermined adjustment factor such that said received signals fall between said upper and lower target limits.

The OFF and ON time can be adjusted by an auto-tune value.

The plunger lift system can further comprise a line pressure sensor capable of measuring high-line pressure, the method further comprising the steps of: using said logic to determine if a high-line pressure delay has occurred since previous flow period; and, adjusting said ON and OFF cycle by a second predetermined adjustment factor.

An improved method of optimizing a ON and OFF cycle of a plunger lift system for a well, the plunger lift system having a cased well, a plunger in the cased well moveable from the bottom of the cased well to a top of the cased well, a stop in the bottom of the well above the perforations, a control valve in functional connection with the cased well, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the improvement comprises said controller having a logic that determines: if a well is a Minimum-OFF well, a Minimum-ON well, or a neither well, and if said plunger arrival velocity falls within a target velocity range, —wherein a Minimum-OFF well or a Minimum-ON well with a plunger velocity outside said target velocity range results in said controller adjusting said open or close trigger threshold by a auto-tune value such that plunger arrival velocity falls within said predetermined target velocity range, —wherein a Minimum-OFF well or a Minimum-ON well with a plunger velocity inside said target velocity range results in no adjustment to said plunger arrival velocity, —wherein a neither well with a plunger velocity outside said target velocity range results in said controller adjusting said open or close trigger threshold by said auto-tune value such that plunger arrival velocity falls within said predetermined target velocity range, —wherein a neither well with a plunger velocity inside said target velocity range results in said controller adjusting taking the aggressive approach and adjusting (decrementing) the open trigger or taking the conservative approach and adjusting (incrementing) the close trigger by an auto-tune set point.

The OFF and ON time can be adjusted by an auto-tune value.

The plunger lift system can further comprise a tubing positioned in said cased well, wherein said plunger is moveable in said tubing from the bottom of the tubing to a top of the tubing and said control valve is in functional connection to the tubing.

The controller can stop plunger arrival velocity adjustments if said plunger fails to arrive for a predetermined consecutive number of cycles.

The plunger lift system can further comprises a line pressure sensor for determine line pressures in said well and said controller can restart logic determinations if said line pressures are too high.

The parameters can include if the plunger arrives, plunger arrival time, valve open time, valve closed time, and if high line delay was activated for a current cycle.

The optimization can include an adjustment equal to an auto-tune increment or decrement value.

The first predetermined adjustment factor can be an auto-tune value.

The second predetermined adjustment factor is auto-tune value*non-arrival multiplier.

The non-arrival multiplier is typically a value between 2 and 3, but could be any value as determined by the operator.

The following examples are intended to be illustrative only, and not unduly limit the scope of the appended claims.

Figure 3:
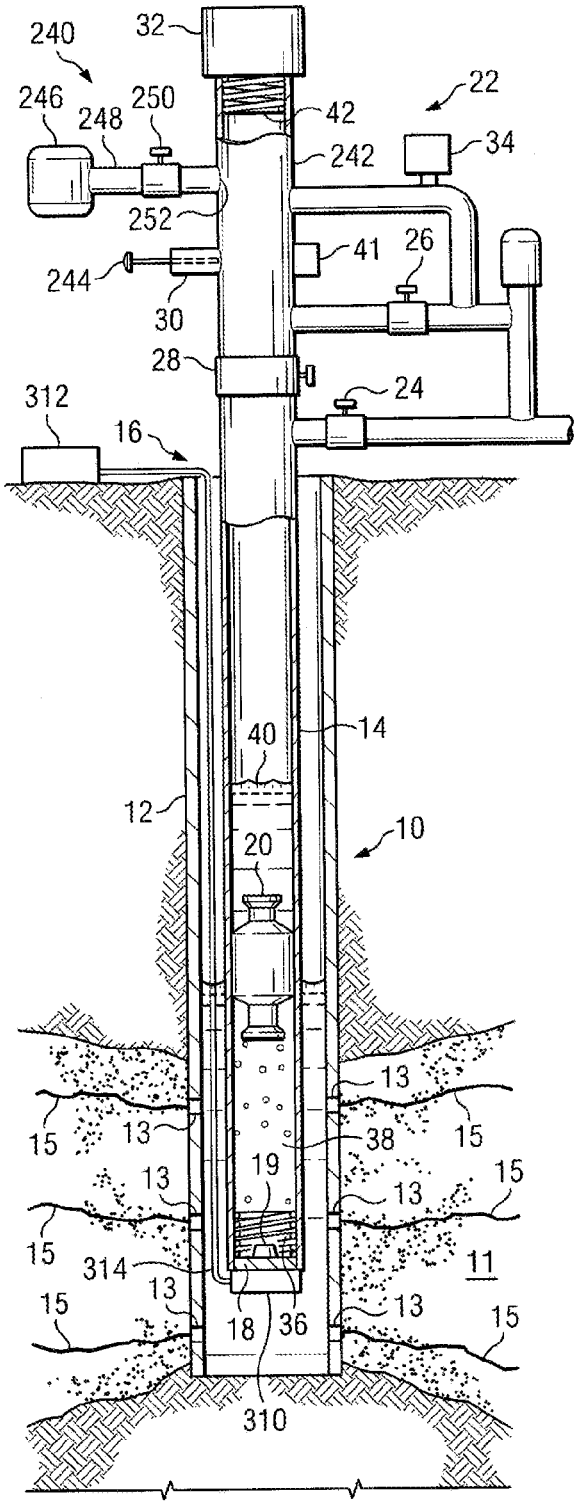
FIG. 3 drawing of a plunger lift system by ConocoPhillips, from U.S. Pat. No. 7,451,823.

With reference to FIG. 3, the oil or gas well will have a wellbore 10 located within petroleum-bearing formation 11 and which typically contains a casing 12 either throughout the entire well or a portion of the wellbore. Within the formation 11 are flow paths 15, either naturally occurring or created by known well stimulation techniques, which allow gas and liquids to move toward the wellbore. The wellbore 10 can also contain tubing 14 within the casing 12. Typically, casing 12 will have one or more perforations 13, which provide a fluid passage between the inside of casing 12 and formation 11.

In a typical arrangement, the well production will flow through the tubing 14 to the wellhead 16. For plunger lift operations the tubing 14 can be provided with a stop 18 or seating nipple 19 at the lower end of the tubing 14, and a plunger 20 which travels in the tubing 14 to the wellhead 16. In a typical arrangement, a manifold 22 is provided at the wellhead 16, which can have a plunger catch 30 to hold the plunger in place, a lubricator 32, and a control box 34 to control the flow of gas and liquid from the well by operating the valves 24, 26, 28 and 250 and related conduits.

Stop 18 is provided to prevent plunger 20 from falling below the position of the stop 18. The stop 18 can include a spring 36 or other shock-absorbing device to reduce the impact of the falling plunger 20. The plunger 20 can be of any of the numerous designs that are known in the art or another delivery system as described herein.

The plunger 20 provides a mechanical interface between the gas 38 and the liquid 40 present in the well. After shutting the well off at the surface, plunger 20 is allowed to fall to the bottom of the well and rest on the stop 18. After pressure builds in wellbore 10, the well is opened and the pressure will push plunger 20 and liquid 40 on top of plunger 20 up the tubing 14 to the surface.

When plunger 20 reaches the top of the well it enters or is received by a manifold 22. Manifold 22 can include a shock absorbing spring 42 or other mechanism to reduce the impact of the plunger. A plunger arrival sensor 41 is provided to detect arrival of the plunger 20 at the surface and if the well is equipped with one, to activate plunger catcher 30, which holds the plunger 20 until a signal is received to release plunger 20. In many cases no automated plunger catcher exists so the plunger remains at the surface until flow ceases or is sufficiently reduced to allow the plunger to fall. Control box 34 contains circuitry for opening and closing the appropriate valves 24, 26, 28, and 250 during the different phases of the lift process.

However, even with the above data gathering and self-adjusting by the control box, the well conditions may not be optimized. Currently, no automated optimization system exists, thus, someone knowledgeable in plunger lift optimization must still monitor the unit and manually adjust parameters to insure the well reaches and maintains an optimized state. This could lead to potential misinterpretations of what adjustments should be made and result in the well spending more time in an un-optimized, and thus less efficient, state.

Figure 8:
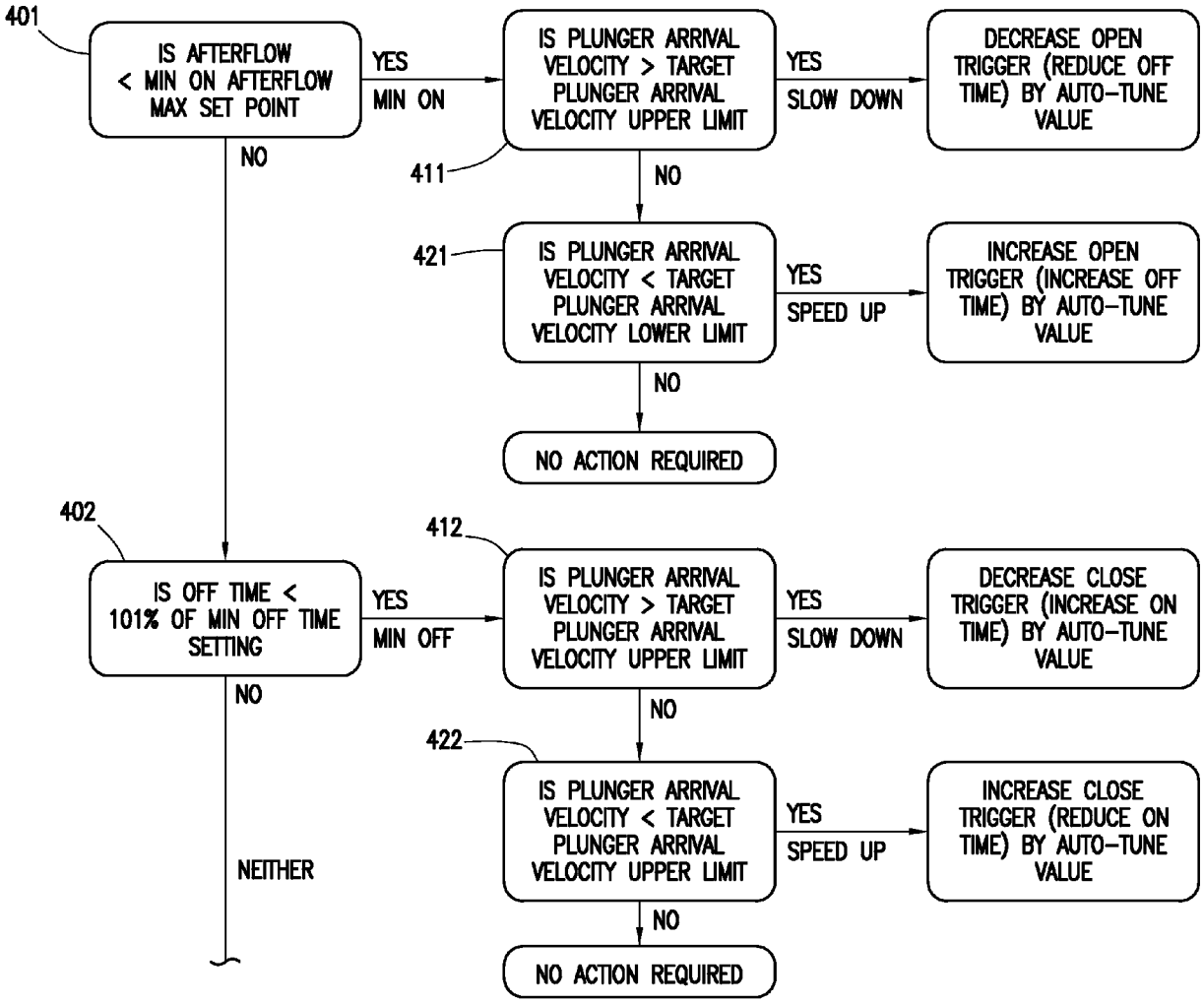
FIG. 8. Schematic of basic logic disclosed herein for plunger lift optimization control.
Figure 8:
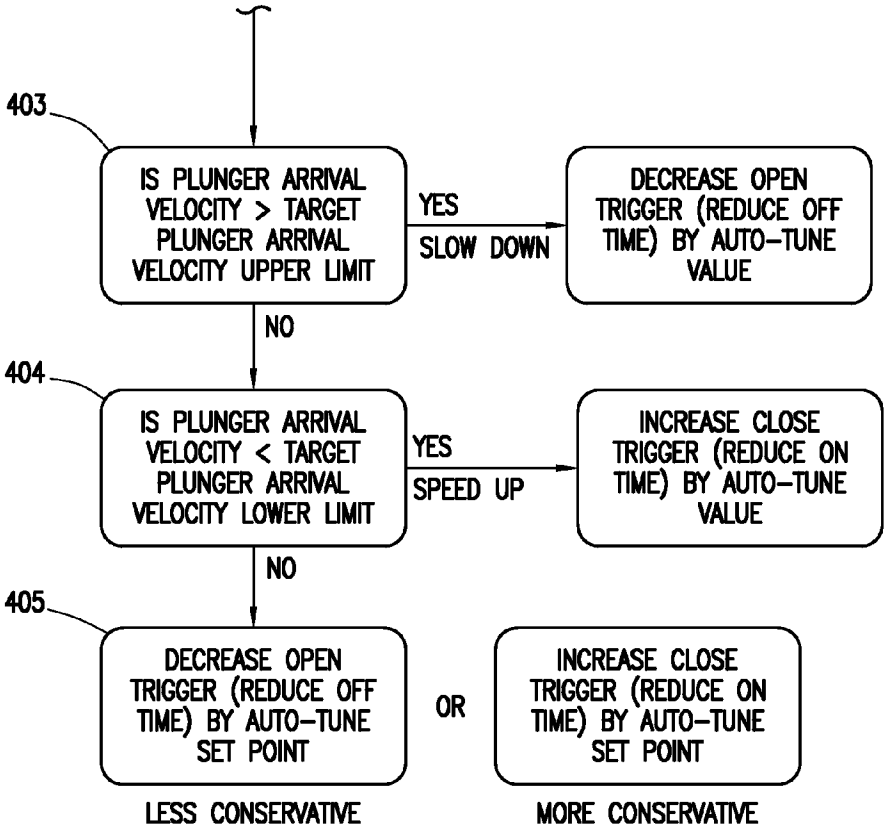
Figure 9:
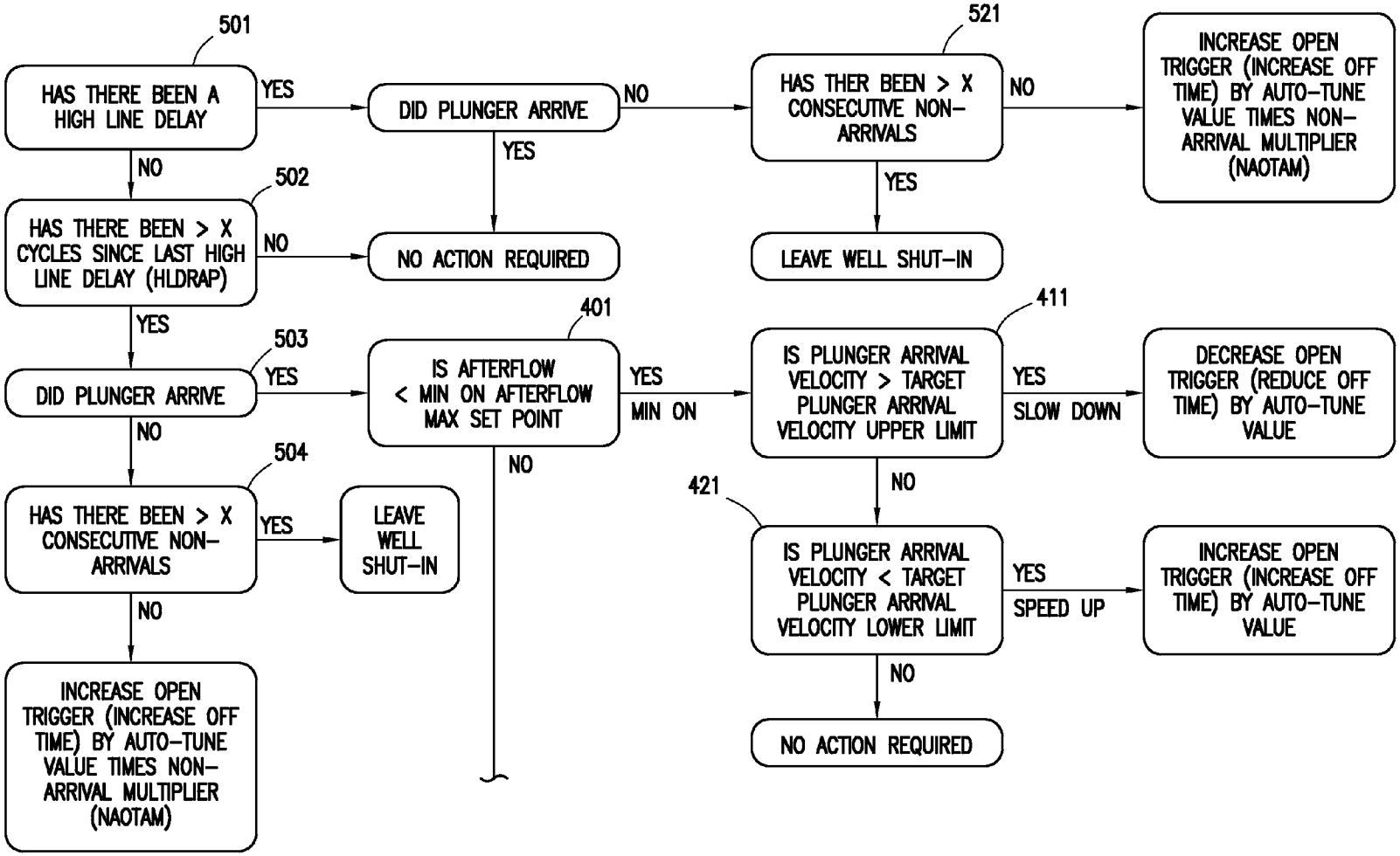
FIG. 9. Schematic of logic for plunger lift optimization control according to one embodiment of the present disclosure.
Figure 9:
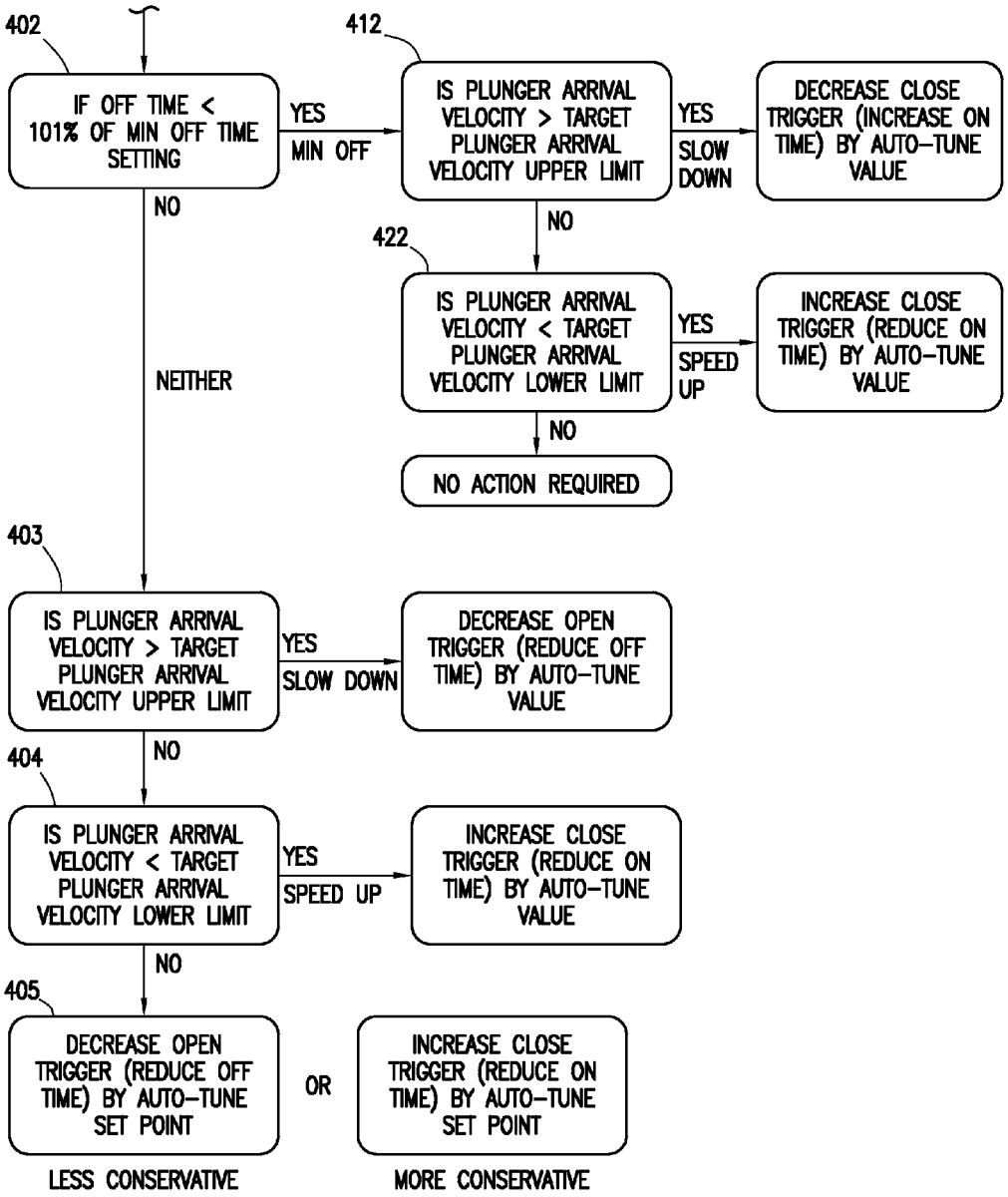

The present disclosure is directed to control box logic that can be implemented with existing plunger lift control logic to automate the optimization process with minimal human intervention. This novel control box logic is exemplified in FIGS. 8 and 9, wherein FIG. 8 shows the basic logic that will be used to auto-optimize the plunger conditions and FIG. 9 shows how the logic commonly employed in other specific well conditions can be integrated with the novel control box logic.

Figure 4:
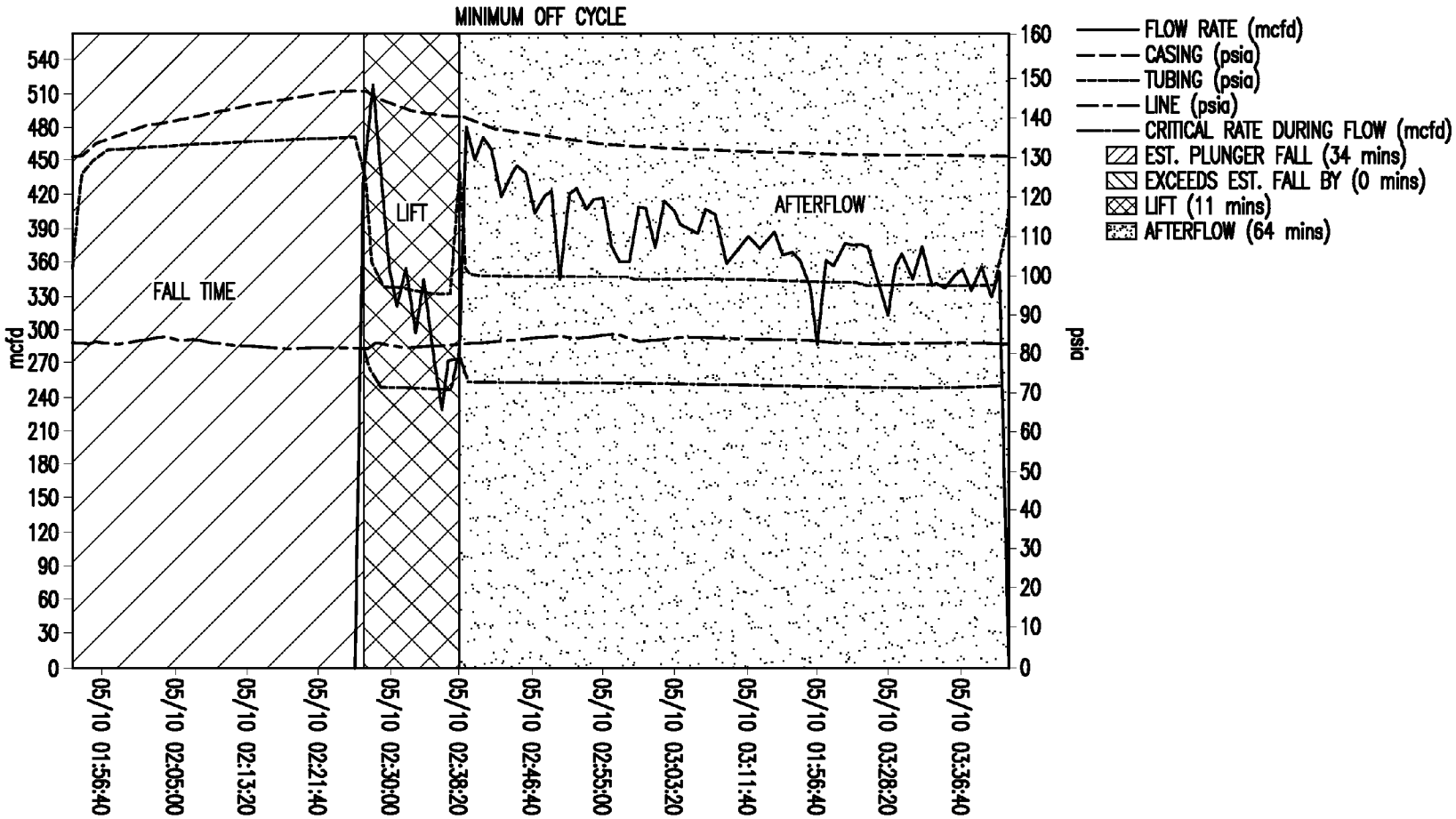
FIG. 4. Chart of pressure and flow rate vs. time showing a typical cycle of a Minimum-OFF time well.
Figure 5:
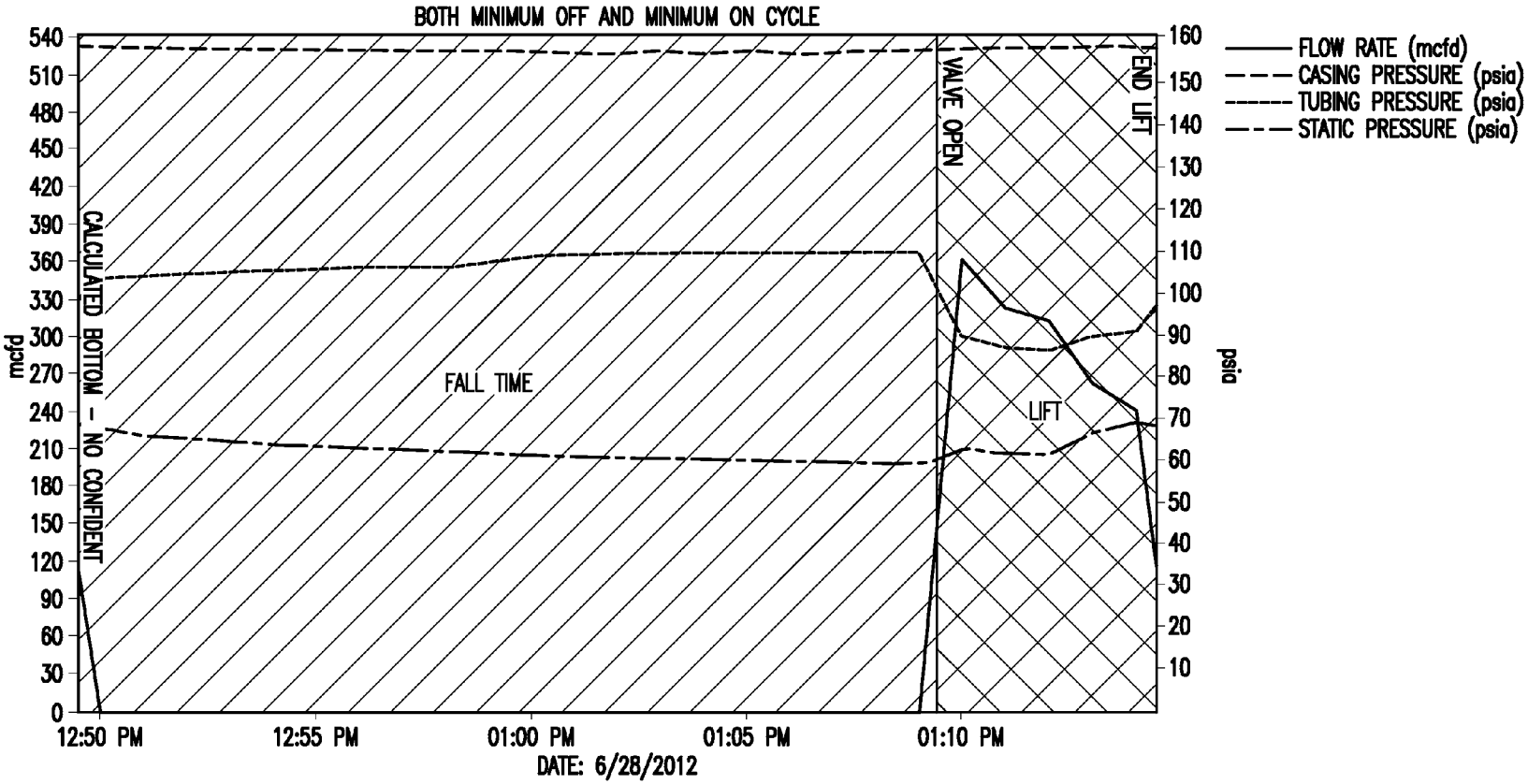
FIG. 5. Chart of pressure and flow rate vs. time showing a typical cycle of a well that meets the criteria for being both a Minimum-OFF time well and a Minimum-ON time well.
Figure 6:
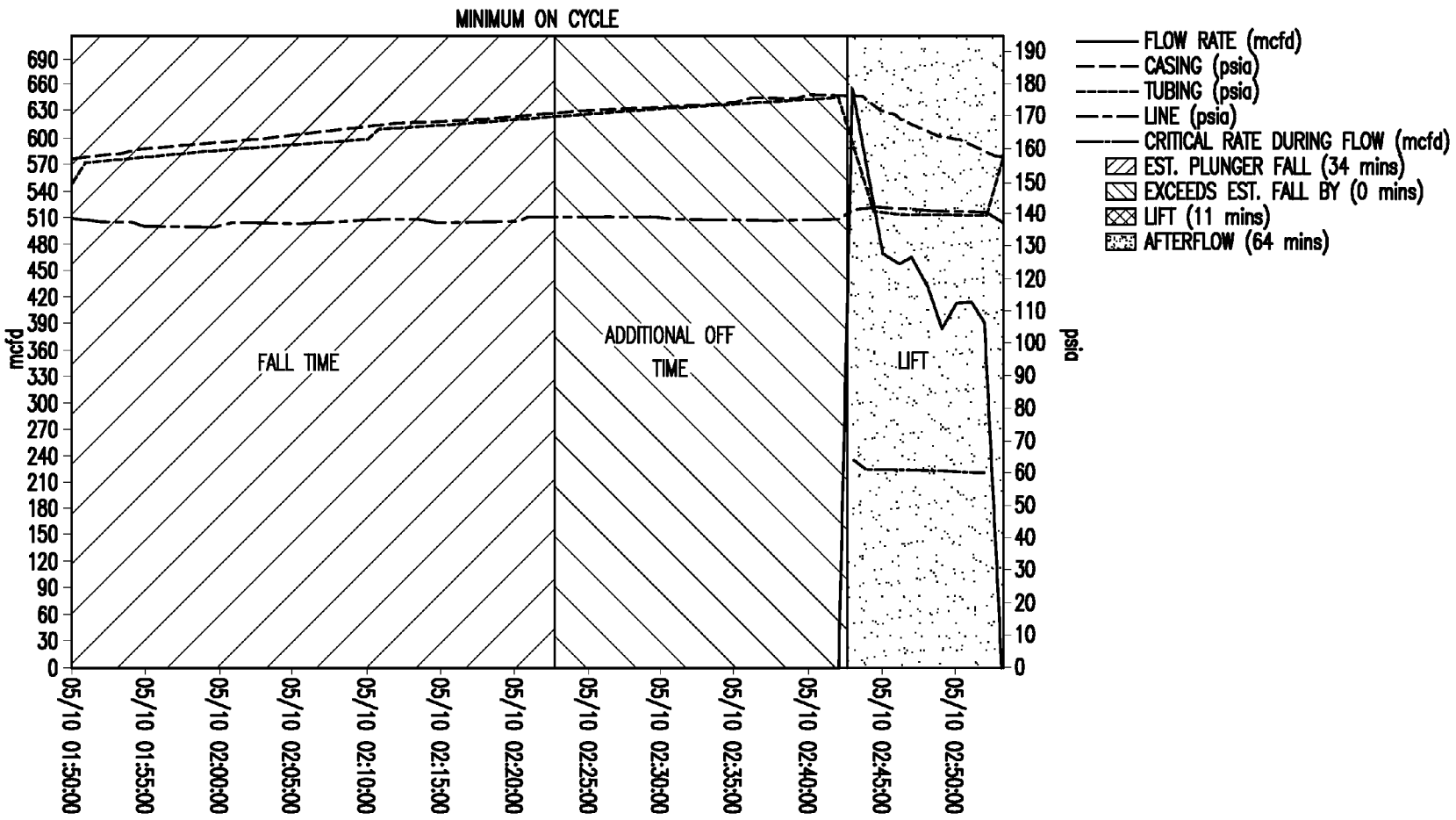
FIG. 6. Chart of pressure and flow rate vs. time showing a typical cycle of a Minimum-ON time well.
Figure 7:
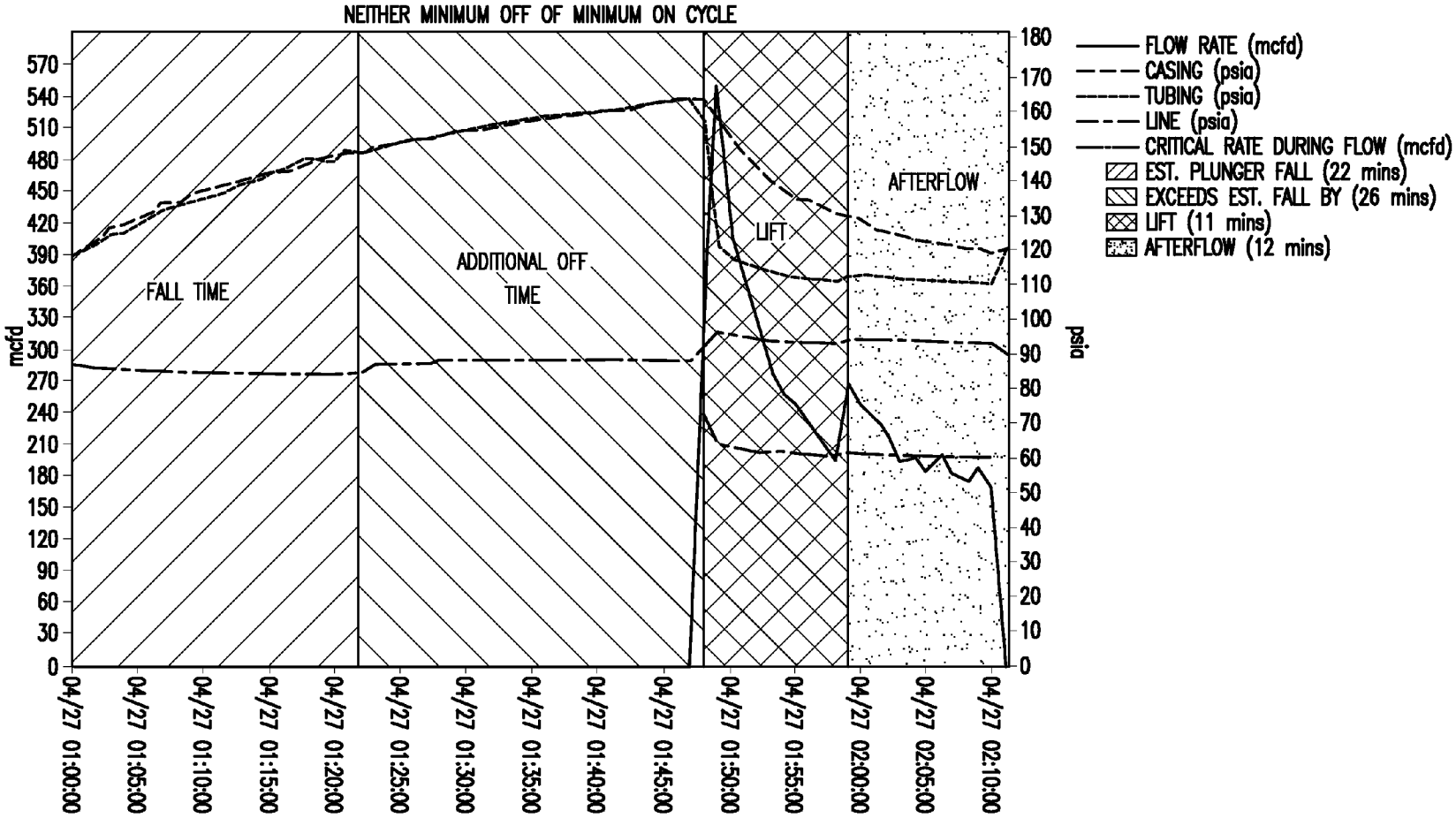
FIG. 7. Chart of pressure and flow rate vs. time showing a typical cycle of a that does not meet the requirements for either a Minimum-OFF time well or a Minimum-ON time well (a "neither").

FIGS. 4-6 display optimized wells and FIG. 7 displays an un-optimized well. A well is optimized when it has a Minimum-OFF time (FIG. 4), a Minimum-ON time (FIG. 6) or both (FIG. 5). The OFF time provides energy and the ON time (flow time including afterflow) determines the size of the accumulated fluid slug.

FIG. 7 shows an un-optimized well, also known as a 'neither' well. In this well, the OFF time is much greater than the minimum time required for the plunger to reach bottom (labeled here as "Fall Time") and the afterflow is greater than 0. Because the cycle has both additional off time beyond the minimum and afterflow, this well is clearly not operating efficiently.

In contrast, an optimized Minimum-OFF well is shown in FIG. 4. In such an optimized well, the well is shut in for the least amount of time possible (Minimum-OFF time) and then allowed to flow for as long as possible to accumulate the largest fluid slug that can still be lifted with the energy available from the Minimum-OFF time.

As reservoir pressure declines, less buildup pressure/energy is available for lift from the Minimum-OFF time, so ON times must be shorter so as to accumulate smaller fluid slugs. Over the life of the well, while maintaining a minimum shut in time, the slug size (and afterflow) gets smaller and smaller until there is no afterflow time at all. At this point, the well is a "both", i.e. both a Minimum-OFF and a Minimum-ON well (FIG. 5).

As the well continues to be produced, reservoir pressure continues to decline, making less energy available with the shut-in in being the Minimum-OFF time. At that point, the OFF time has to be increased beyond the minimum to accumulate energy to lift the smallest fluid slug possible (afterflow time has been reduced to zero), thus creating a Minimum-ON well (FIG. 6).

To illustrate the difference another way, early in the life of the well, the number of cycles per day start out being very few in a Minimum-OFF well because a larger afterflow time is needed to produce the largest slug size for the corresponding lift pressure accumulated during the Minimum-OFF time. Because the lift energy accumulated during the Minimum-OFF time declines with reservoir pressure, the number of cycles increases until it reaches a maximum when the well is a "both" because no afterflow time is needed to produce the largest slug size possible, although very small for the corresponding lower lift pressure.

The number of cycles decreases again as the reservoir pressure continues to decline, because the well must be shut in for additional time to accumulate the pressure (or energy) needed to lift the smaller slugs generated with no afterflow. Finally, the produced gas decreases as the reservoir pressure declines until the well is abandoned.

The logic described herein automatically adjusts for all of these changes over the life of the well. Before proceeding through the logic steps, some information is needed from the controller. This includes the valve on and off time, plunger arrival time, whether plunger actually arrived, and was there a High Line Delay since last flow period. From this information, certain calculations are made to determine consecutive non-arrivals, afterflow length, off time length, plunger arrival velocity and how many cycles have occurred since a High Line Delay. The information and calculations are used by the controller to make adjustments to the system as the controller proceeds through the steps of the logic.

Referring to FIG. 8, the first step in the logic is determining whether the well is a Minimum-ON (401) or Minimum-OFF (402) or both by comparing the afterflow of the cycle to the Minimum-ON afterflow maximum set point. Afterflow is the time the well is allowed to produce after the plunger has surfaced. If afterflow time is greater than the targeted limit, then the well is not a "Minimum-ON well", so it may not be optimized and producing efficiently. However, the well could still be a "Minimum-OFF well" and thus optimized.

In determining a Minimum-ON well (401), if the afterflow is less than the Minimum-ON maximum afterflow set point, the well is a "Minimum-ON well" and the logic proceeds to the next question regarding plunger arrival velocity (411). The actual plunger arrival velocity is compared to the target plunger arrival velocity upper limit. If the actual velocity is larger, then the control box will attempt to slow down the plunger velocity on the next cycle by decreasing the OPEN trigger threshold by the open trigger auto-tune decrement value. This adjustment should result in a shorter shut-in time, thus reducing the amount of pressure built during OFF time. A lower amount of pressure available for lift will result in the plunger having a slower rise velocity.

If the plunger velocity is smaller than the target plunger arrival velocity lower limit (421), the control box will attempt to speed up the plunger on the next cycle by increasing the OPEN trigger threshold by the open trigger auto-tune increment value. This will result in a longer shut-in time, resulting in an increased amount of pressure during the OFF period. A higher pressure will push the plunger at a higher velocity.

The control box makes no changes if the actual plunger velocity falls within the upper/lower limits of the target arrival velocity. This is because the well is meeting the criteria for being a Minimum-ON well with the plunger arriving at the desired velocity. Note, for most open triggers, there exist a proportional relationship between the OPEN trigger and the OFF time. Thus, increasing the OPEN trigger threshold increases the OFF time.

As mentioned previously, if the afterflow is greater than the Minimum-ON maximum afterflow set point, then the actual OFF time is compared with the Minimum-OFF time setting (402) to determine if the well is an optimized Minimum-OFF well. If the actual OFF time that is less than or equal to the Minimum-OFF time setting (i.e. less than 101% of the Minimum-OFF time setting), the well is a "Minimum-OFF well". Much like before, the controller will then compare the plunger velocity with the upper/lower limits of the target plunger arrival time.

If the actual velocity is larger (412), then the control box will attempt to slow down the plunger velocity on the next cycle by decreasing the CLOSE trigger threshold by the close trigger auto-tune decrement value. This should result in more afterflow time thus increasing the size of the slug to be lifted during the next cycle. If the plunger velocity is smaller than the target plunger arrival velocity lower limit (422), the control box will attempt to speed up the plunger on the next cycle by increasing the CLOSE trigger threshold by the close trigger auto-tune increment value. This should result in less afterflow time thus decreasing the size of the slug to be lifted during the next cycle. Note, for most close triggers there exist an inverse relationship between the CLOSE trigger and the ON time. Thus, increasing the CLOSE trigger threshold decreases the ON time.

The control box makes no changes if the actual plunger velocity falls within the upper/lower limits of the target arrival velocity. This is because the well is meeting the criteria for being a Minimum-OFF well with the plunger arriving at the desired velocity.

It should be noted that logic steps 401 and 402 are interchangeable. In other words, the logic can determine if the well is a Minimum-ON well (401) and if not, check to see if it is a Minimum-OFF well (402), or check to see if it is a Minimum-OFF well (402) and if not, check to see if it is a Minimum-ON well (401). If, in the first step, the well is optimized, then the logic will not check to see if the well meets the other optimize state.

If neither the afterflow or OFF time is below their minimum set point, then the actual plunger arrival velocity is checked against the upper (403) and lower set limits (404). If the plunger velocity is outside the target limits, then steps are taken to decrease/increase the velocity in an effort to move towards one of the optimized states. If the actual plunger arrival velocity falls above the upper limit (403), then the OPEN trigger is reduced by the open trigger auto-tune decrement, and subsequently, the OFF time is decreased. If the actual plunger arrival velocity falls below the lower limit (404), then the CLOSE trigger is increased by the CLOSE trigger auto-tune increment, and subsequently, the ON time is decreased.

If the plunger velocity is within the target limits, yet is neither a Minimum-ON or Minimum-OFF well, then the logic moves the cycle toward one of those two states (405) by either taking a less conservative approach by decreasing the OPEN trigger by the open trigger auto-tune decrement value and slowing the plunger arrival velocity to a value below the plunger arrival velocity lower limit, or it can be set to take a more conservative approach by increasing the CLOSE trigger by the CLOSE trigger auto-tune increment value and speed up the plunger arrival velocity above the plunger arrival velocity upper limit.

Then after the next cycle, the logic will adjust to either the OPEN or CLOSE trigger to bring the velocity back between the upper and lower plunger arrival velocity limits. After several cycles (iterations) the well will be moved to either a Minimum-OFF well or a Minimum-ON well, or in a rare occasion both a Minimum-OFF and a Minimum-ON well with the plunger arrival velocity within the desired limits.

It should be noted that the adjustments, increments/decrements (i.e. auto tune value), can be preprogrammed into the logic. Exemplary numbers will vary depending on the trigger used (e.g. C/L, T/L, LR, flow rate, % critical lift rate, etc.) and just how big of adjustments the operator wants the controller to make (see the examples under [0050] and [0052]. These are typically a set number (e.g. a setting in the controller). However, it may be possible to incorporate a variable approach to the increment and decrement as a future enhancement. In fact, some controllers already allow for a variable increment or decrement depending on how far the plunger speed is from the desired range.

The logic displayed in FIG. 8 is used to move the plunger lift towards an optimized status (e.g. Minimum-OFF or Minimum-ON) with minimal human intervention. Thus, once properly installed in the current control box, the plunger lift adjustments will be automated and monitored as optimization is reached and maintain. However, FIG. 8 is directed to a plunger system that is working properly, in that the plunger is consistently arriving and hydrocarbon is being produced, but needs adjustments to reach an optimized state.

However, there can also be certain "exception" events that can occur requiring specific action. Examples of these events include high line pressure events and plunger non-arrivals. If the plunger lift system is having issues such as these, then specific problems can be addressed by a simple addition on the front of the logic, as shown in FIG. 9 for a high-line pressure delay event or consecutive plunger non-arrivals.

FIG. 9 shows the logic for a well with high line pressure issues. When line pressures are too high for the plunger to operate, the high-line pressure delay will override the normal control of the plunger and halt the plunger cycle shutting in the well. Automated controllers typically will allow for the pressure to drop before restarting the shut-in cycle again. Other controllers will send alarms, emails, text, and the like to operators. However, the present logic will run through a series of determinations to automatically adjust the parameters to help the well recover from the high line pressure conditions, if the plunger did not arrive prior to the line pressure increase.

If there has been a high-line pressure delay, then the logic determines if the plunger has arrived. If the plunger has not arrived, it checks to see if there has been more than the allowable number (X) of consecutive non-arrivals (521). If the allowable number is exceeded, the well is shut in to allow the line pressure to lower. Once lower, then the well cycle will restart. If the allowable number of consecutive non-arrivals has not occurred, then OPEN trigger is increased to increase the OFF time. The amount that the trigger is increased is equal to (open trigger auto-tune increment value)*(non-arrival multiplier). The non-arrival multiplier is simply a way to increase the adjustment such that more energy can be accumulated in an attempt to get the well back on track and prevent it from logging off, which may result if the adjustment is only equal to the auto-tune value. A typical multiplier is any value between 2-6, preferably 2-4, and most preferably 2-3. If the plunger did arrive, no action is taken and the system is allowed to reset.

When the well is recovering from a high line pressure event, the logic halts any optimization adjustments until the cycle count since the last high line pressure delay has exceeded a set point value (HLDRAP) (502). Once the target number of cycles is reached, the control will essentially perform a systems check to make sure the plunger is arriving 503. It if is, then the control will move through the decision tree displayed in FIG. 8. If the plunger has not arrived, then the system checks the number of consecutive non-arrivals against a target number. If the non-arrivals are greater than the target number, then the well is shut in until an operator visits the well to troubleshoot the problem or help the well recover. If the target number is not met, then the OPEN trigger is increased as described above by a factor equal to (Auto-tune value)*(non-arrival multiplier). This is done to give the well more build up pressure/energy to make sure the plunger and slug arrives at the surface on the next trip.

The novel logic described above provides an automated method of optimizing the well and maintaining the optimized status. Also, because the logic is automating the process, it will seamlessly change the cycle characteristics to maintain the minimum bottom hole pressure as reservoir, surface conditions, and equipment related items change.

It is well understood by those familiar with well optimization principles, that uplift is dependent on the change in bottom hole pressure and current reservoir pressure. Experiments showed that use of the aforementioned logic results in a lower bottom hole pressure and therefore uplift values in the ranges expected.

The present invention is exemplified with respect to FIG. 8-9, However, these figures are exemplary only, and the invention can be broadly applied to a variety of well characteristics encountered by plunger lift wells.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 7,451,823 (Wilson); "Well chemical treatment utilizing plunger lift delivery system with chemically improved plunger seal" (2008).
2. U.S. Pat. No. 7,681,641 (Mudry); "Plunger lift controller and method" (2008).
3. U.S. Pat. No. 7,464,753 (White & Coley); "Methods and apparatus for enhanced production of plunger lift wells" (2008).
4. U.S. Pat. No. 6,241,014 (Majek, Dees, Drobnic & Fields); "Plunger lift controller and method" (2001).
5. U.S. Pat. No. 5,957,200 (Fields & Majek); "Plunger lift controller" (1999).

What is claimed is:

1. An improved method of optimizing a ON and OFF cycle of a plunger lift system for a well, the plunger lift system having a cased well, a plunger in the cased well moveable from a stop at the bottom of the cased well to a top of the cased well, a control valve in functional connection with the cased well, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the improvement comprises said controller optimizing for Minimum-OFF time for said plunger, or optimizing for Minimum-ON time for said plunger, or both based on current cycle parameters wherein a logic for making decisions based on receiving signals compares current cycle parameters with target parameter limits and adjusts the ON and OFF cycle by an auto-tune increment or decrement according to said evaluations.

2. An improved method of claim 1, wherein said parameters include if the plunger arrives, plunger arrival time, valve open time, valve closed time, and if high line delay was activated for a current cycle.

3. The method of claim 1, wherein said optimization is an adjustment equal to an auto-tune increment or decrement value.

4. The method of one of claims 1, 2, or 3, wherein the plunger lift system further comprises a tubing positioned in said cased well, wherein said plunger is moveable in said tubing from the bottom of the tubing to a top of the tubing and said control valve is in functional connection to the tubing.

5. A method for auto-optimizing the operation of a plunger lift well comprising a well casing, production string within the well casing, a take-off line in fluid communication with the production string, a plunger within the production string, a stop near the bottom of the production string, a plunger lift control valve connected between the production and the take-off line, and a controller system, the controller system having a logic that compares actual well parameters with target parameters and a memory, wherein said controller system serves to open and close the plunger lift control valve according to values calculated and makes adjustments to said values based on comparisons made by the logic, said method comprising the steps of:

a) entering a predetermined upper limit for afterflow time during a Minimum-ON cycle time, a plunger arrival velocity, an open time, a closed time, a multiplier and an auto-tune value into the controller system memory, wherein the controller system automatically calculates the open time based on the entered predetermined values;

b) conducting one or more operating cycles wherein the controller system opens and closes the plunger lift control valve to allow fluids or hydrocarbons to flow into the take-off line, said one or more operating cycles comprising:

i) entering a closed cycle and closing the plunger lift control valve for a period of time equal to the initial close time;

ii) entering an open cycle and opening the plunger lift control valve for a period of time equal to the calculated open time and allowing fluids to be artificially lifted by the plunger within the production string for a lift time; and iii) entering an afterflow cycle for an after flow time equal to open time minus said lift time, wherein said fluids and hydrocarbons flow into the take-off line during said afterflow cycle; and c) adjusting the close time or open time, wherein the logic cycles compares the current operating afterflow time with said upper limit of afterflow time during a Minimum-ON cycle time and, if said current operating afterflow time is smaller, then said logic compares operating plunger velocity with the predetermined upper and lower limits and adjusts the close time according to said evaluations, and if said afterflow time is greater, then said logic compares the current operating off time with said upper limit of Minimum-OFF time during a Minimum-OFF cycle time and, if said current operating off time is less than or equal to Minimum-OFF time, then said logic compares operating plunger velocity with the predetermined upper and lower limits and adjusts the open time by an auto-tune increment or decrement according to said evaluations;

d) conducting one or more adjusted operation cycles, each adjusted operation cycle comprising:

i) entering a closed cycle for a period of time equal to the adjusted close time and closing the plunger lift control valve;

ii) opening the plunger lift control valve for a period of time equal to the calculated open time and allowing fluids to be artificially lifted by the plunger within the production string for a lift time; and iii) entering an adjusted afterflow cycle for an adjusted after flow time equal to the adjusted open time minus said lift time, wherein said fluids and hydrocarbons flow into the take-off line during said adjusted afterflow cycle; and e) repeating c-d until said operating afterflow is within said lower than said upper limit of afterflow time and said operating plunger velocity is within said predetermined upper and lower limits.

6. A improved plunger lift system, wherein the plunger lift system having a tubing positioned in a cased well, a plunger in the tubing moveable from the bottom of the tubing to a top of the tubing, a stop near the bottom of the production string, a control valve in functional connection with the tubing, a control valve sensor for measuring time valve is open or closed, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the receiving signals relay real time values of said system parameters of each preceding cycle, said improvement comprising:

a) a logic sequence for incorporation in said controller that evaluates real time operating afterflow value against a predetermined target afterflow range, wherein a smaller real time afterflow value results in a first evaluation of the actual plunger velocity against predetermined target velocity range and adjust to the OFF time based on said evaluation, wherein a larger real time afterflow value results in a comparison of real OFF time to predetermined OFF range and a smaller real OFF time results in a second evaluation of the actual plunger velocity against predetermined target velocity range and adjust to the ON time based on said evaluation and a larger real OFF time results in a third evaluation of the actual plunger velocity against predetermined target velocity range and adjust to the ON and OFF time based on said evaluation; and b) said logic sequence comparing current cycle afterflow with target afterflow limits and adjusts the ON and OFF cycle by an auto-tune increment or decrement according to said afterflow evaluations.

7. The improved method of claim 6, wherein said OFF and ON time are adjusted by an auto-tune value.

8. A method of monitoring and optimizing a ON and OFF cycle of a plunger lift system for a well, the plunger lift system having a tubing positioned in a cased well, a plunger in the tubing moveable from the bottom of the tubing to a top of the tubing, a stop near the bottom of the tubing, a control valve in functional connection with the tubing, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the receiving signals relay actual values of said system parameters, a logic for making decisions based on receiving signals, the method comprising the steps of:

a) defining an upper and lower target limit for an afterflow time, said plunger arrival velocity, an ON time and an OFF time;

b) using said logic to compare said received signals with said target limits in a) to determine if said received signals fall outside said limits, wherein said logic determines an adjustment to an ON or OFF cycle is necessary if said received signals fall outside said limits, and c) adjusting said ON and OFF cycle by a first by an auto-tune increment or decrement according to said afterflow evaluations such that said received signals fall between said upper and lower target limits.

9. The method of claim 8, wherein said plunger lift system further comprises a line pressure sensor capable of measuring high-line pressure, the method further comprising the steps of:

a) using said logic to determine if a high-line pressure delay has occurred since previous flow period, wherein; and, b) adjusting said ON and OFF cycle by a second predetermined adjustment factor.

10. The method of claim 8, wherein said first predetermined adjustment factor is an auto-tune value.

11. The method of claim 8, wherein said second predetermined adjustment factor is auto-tune value by non-arrival multiplier.

12. An improved method of optimizing a ON and OFF cycle of a plunger lift system for a well, the plunger lift system having a cased well, a plunger in the cased well moveable from the bottom of the cased well to a top of the cased well, a stop in the bottom of the well above the perforations, a control valve in functional connection with the cased well, a plunger arrival sensor capable of measuring a plunger arrival velocity, a flow valve sensor capable of measuring time flow valve is open or closed, a controller in operational connection with the control valve and functional connection with the sensors for receiving signals from the sensors, wherein the improvement comprises said controller having a logic that determines:

a) if a well is a Minimum-OFF well, a Minimum-ON well, or a neither well, and b) if said plunger arrival velocity falls within a target velocity range, i) wherein a Minimum-OFF well or a Minimum-ON well with a plunger velocity outside said target velocity range results in said controller adjusting said plunger arrival velocity by an auto-tune value such that it falls within said predetermined target velocity range, ii) wherein a Minimum-OFF well or a Minimum-ON well with a plunger velocity inside said target velocity range results in no adjustment to said plunger arrival velocity, iii) wherein a neither well with a plunger velocity outside said target velocity range results in said controller adjusting said plunger arrival velocity by said auto-tune value such that it falls within said predetermined target velocity range, iv) wherein a neither well with a plunger velocity inside said target velocity range results in said controller adjusting (decrementing) the open trigger or adjusting (incrementing) the close trigger by an auto-tune set point.

13. The improved method of claim 12, wherein the plunger lift system further comprises a tubing positioned in said cased well, wherein said plunger is moveable in said tubing from the bottom of the tubing to a top of the tubing and said control valve is in functional connection to the tubing.

14. The improved method of one of claims 12 or 13, wherein said controller can stop plunger arrival velocity adjustments if said plunger fails to arrive for a predetermined consecutive number of cycles.

15. The improved method of one of claims 12 or 13, wherein said plunger lift system further comprises a line pressure sensor for determine line pressures in said well and said controller can restart logic determinations if said line pressures are too high.

* * * * *